United States Patent [19]

Month et al.

[11] 4,196,372

[45] Apr. 1, 1980

[54] PICK-UP TUBE HAVING BIAS LIGHTING AND CONTROLS THEREFOR

[75] Inventors: Alfred Month, Lancaster; Timothy E. Benner, Rohrerstown, both of Pa.

[73] Assignee: RCA Corporation, New York, N.Y.

[21] Appl. No.: 913,340

[22] Filed: Jun. 7, 1978

[51] Int. Cl.[2] ..... H01J 31/26

[52] U.S. Cl. ..... 315/10; 313/371; 313/372; 313/478

[58] Field of Search ..... 313/371, 372, 478; 315/10

[56] References Cited

U.S. PATENT DOCUMENTS

| | | | |
|---|---|---|---|
| 2,916,661 | 12/1959 | Davis | 315/10 X |
| 3,445,826 | 5/1969 | Myers | 313/371 X |
| 3,628,076 | 12/1971 | Weijland et al. | 313/372 X |
| 3,751,703 | 8/1973 | Weijland et al. | 313/384 |
| 3,892,994 | 7/1975 | Scholz | 313/371 |
| 3,925,699 | 12/1975 | Banks et al. | 313/384 |
| 3,978,365 | 8/1976 | Limper | 313/372 |
| 3,986,070 | 10/1976 | Scholz | 313/371 X |
| 4,019,083 | 4/1977 | Limper | 313/372 |

*Primary Examiner*—Malcolm F. Hubler

*Attorney, Agent, or Firm*—Eugene M. Whitacre; Glenn H. Bruestle; Vincent J. Coughlin, Jr.

[57] ABSTRACT

A vacuum envelope contains a photoconductive target at one end and a tubular anode electrode having light scattering properties. Light is uniformly reflected onto the target by the anode electrode from a light source mounted on the other end of the tube, outside the evacuated envelope. This uniform illumination tends to reduce build-up and decay lags at low level operating conditions. The light source is removably secured to the tube on a ceramic board incorporating an electric circuit connected to the light source for adjusting and controlling the bias light intensity.

7 Claims, 5 Drawing Figures

PICK-UP TUBE HAVING BIAS LIGHTING AND CONTROLS THEREFOR

BACKGROUND OF THE INVENTION

1. Field of the Invention

This invention relates to pick-up tubes and more particularly to pick-up tubes of the photoconductive target type that are light biased including circuit controls for the light bias.

2. Description of the Prior Art

In camera tubes of the photoconductive target type, such as the Vistacon, the target exhibits a natural, relatively low dark current. In the lead monoxide pick-up tubes, particularly, this photoconductor has a tendency to cause undesirably slow "build-up" and "decay" lags in the signal. "Build-up lag", as is used in the art, is the time required for the signal to reach its steady state operating level after the tube is turned on. On the other hand, "decay lag" is the time required for the signal to drop from the steady state level after the tube is turned off. It is desirable for these tubes to have rapid build-up and decay response periods. A slow build-up lag, for example, can cause undesirable color shifts in a color camera, especially at low light levels.

Improvements have been made in reducing build-up and decay lags by adding an artificial dark current by auxiliary illumination of the target. As is known, this illumination is achieved by incorporating a weak light source in the tube for conducting additional light to the tube target. These bias light sources may be internal or external to the evacuated glass tube envelope.

In U.S. Pat. No. 3,628,076, issued Dec. 14, 1971 to Weijland et al, an additional light source is provided on the outside of the sealed evacuated envelope. Light is transmitted from the source by glass light conductors to a collector space in the tube and from there the light is distributed uniformly over the target by diffuse reflection. In U.S. Pat. No. 3,986,070, issued Oct. 12, 1976 to Scholz, an additional light source is mounted internally or externally of the tube envelope. In the external arrangement, a cavity is formed to extend into the tube interior for receiving the light source, so that the source fits within the overall tube outline as well as being sealed against the tube vacuum. The source is accessible and may be removed without destroying the tube vacuum.

One of the problems of the heretofore described prior art arrangements is fabrication. The Scholz convoluted cavity formed into the glass envelope is relatively difficult to fabricate and very likely induces additional strain in the glass, leading to higher scrap rates. Another problem associated with light biasing is the control of the intensity of the light illuminating the target. Often times, different photoconductive layers will react differently to bias light so that the light intensity should be varied to achieve uniformly consistent output. Colored glass filters and lamps of different colors have been used in prior art devices to vary partially the bias light shading and intensity.

Lastly, especially where light sources are utilized external to the glass envelope, a problem arises in the uneven transmission of light through the walls of the glass envelope to the tube faceplate. This light impinges on the target, in particular, at the edges, creating a non-uniform light distribution across the target area. This undesirable light from the glass envelope limits the control of the light guided to the target and, thereby control of the additional dark current.

SUMMARY OF THE INVENTION

A pick-up tube includes a photoconductive target and a light source disposed to provide an illumination onto the target for biasing the dark current of the target. Included in the tube is means for removably mounting the light source to the tube. The mounting means further includes means for presetting and adjustably controlling the light intensity of the light source.

DETAILED DESCRIPTION OF THE PREFERRED EMBODIMENT

Figure 1:
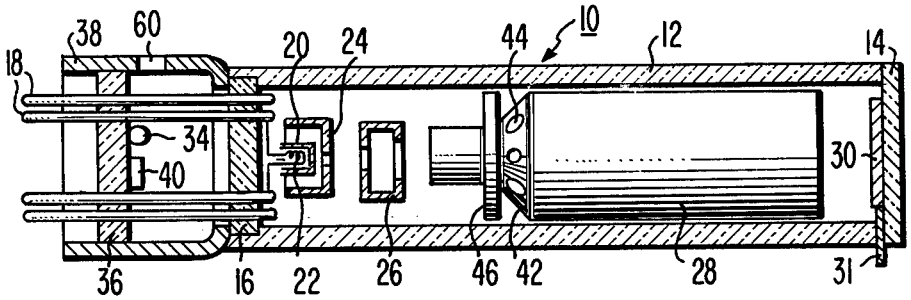
FIGS. 1 and 2 are elevation views partly in section of camera type pick-up tubes including light source and bias light controls showing alternative light conducting arrangements.

Referring to the drawing, there is shown in FIG. 1 a photoconductive target pick-up tube 10, comprising a cylindrical glass envelope 12, enclosed at one end by a transparent faceplate 14 and at the other end by a transparent base plate 16. Contact pins 18 extend through and are sealed to the base plate 16. The faceplate 14 and the base plate 16 are sealed to the glass envelope 12 by known conventional glassing method for providing vacuum-tight seals. The enclosed interior of the tube is suitably evacuated by vacuum techniques that are well known in the art.

Figure 3:
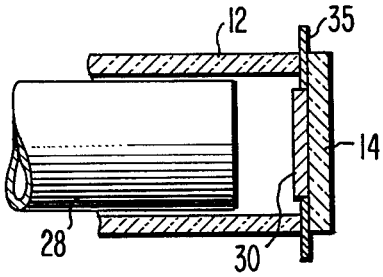
FIG. 3 is a fragmented, partly sectioned elevation view of the faceplate end of the tubes shown in FIGS. 1 and 2 showing an optical isolator disposed between the faceplate and tube envelope.

The tube comprises a cathode 20 which is heated by a filament 22, the filament 22, for example, being connected to two of the contact pins 18. Electrodes 24 and 26 are the normally provided electrodes for controlling the electron beam from the cathode 20. The last electrode of the electron lens of the tube 10 is a tubular anode electrode 28. A photoconductive target 30 is situated on the inside of the faceplate 14. An electrical contact may be made to the target 30 by a connector 31. The connector 31, typically a tab or strip of metal, such as platinum, is connected to the target and extends through the glass envelope 12 in a vacuum seal for making external electrical connections. In an alternative, preferred arrangement, a metallic ring connector 35 may be used to make electrical contact to the target 30, as shown in FIG. 3. The ring 35, vacuum sealed between the faceplate 14 and the envelope 12, is connected to the target and extends circumferentially beyond the periphery of the envelope 12 for making external electrical connections. The ring connector 35, preferably aluminum, also serves as an optical isolator, preventing any light which may be conducted through the envelope 12 from striking the target 30, especially at the edges of the target 30. This optical isolation minimizes non-uniformities in illumination of the target 30.

In the preferred embodiment, the target 30 comprises a layer of lead monoxide (PbO) deposited on a film of conductive tin oxide on the inside portion of the faceplate 14. The PbO target typically exhibits a low dark current (approximately 0.5 nanoamperes) which results in an output signal having a relatively low amount of noise. Other photoconductive materials may also be used in the target 30, such as, for example, selenium arsenic tellurium, cadmium selenide and materials employing PIN configurations or blocking layers for providing low dark currents.

The target can be biased at a predetermined dark current, as is well known in the art, by providing a given uniform auxiliary illumination or background illumination of the target 30. By increasing the tube dark current, which is the current which exists in the absence of illumination, the time required to build-up to and decay from the steady state current level is reduced. On the other hand, an addition in dark current will disadvantageously increase the noise factor in the output signal. Such a noise increase can generally be tolerated within acceptable operating limits at the advantage of reducing the build-up and decay lags.

In the present arrangement, the auxiliary illumination of the target 30 is provided by a light source 34 that is disposed external to the tube vacuum. The light source 34 is mounted on a non-conductive board 36, preferably formed of ceramic, fiber glass or rigid plastic such as Nylon, Delron or polyvinylchloride (PVC). The board 36 is removably secured, such as by a glue or epoxy, to the inner surface of a cylindrical tube end cap 38 that is adhesively fastened to the base plate 16. The contact pins 18 extend through the board 36 and protrude beyond the open end of the end cap 38 for connection to a suitable socket, not shown. The light source 34 and bias light control 40 are mounted on board 36, as will be detailed subsequently.

As shown in FIG. 1, the tubular anode electrode 28 has a tapered portion 42 including a plurality of apertures 44. Light from the light source 34 is transmitted through the transparent base plate 16 into the evacuated interior of the tube 10. The apertures 44 permit the transmitted light to enter the interior of the tubular anode electrode 28. The inner surface is processed according to suitable chemical or mechanical etching methods to have a relatively rough surface to provide light scattering properties. The light entering the inside of the anode electrode 28 and striking the roughened surface is reflected in a diffuse manner and is uniformly distributed over the target 30 in a manner well known in the art. A colored glass filter or diffuser 46 may be disposed between the light source 34 and the apertures 44, preferably adjacent the tapered portion 42, to control partially the light intensity from the light source 34.

Figure 2:
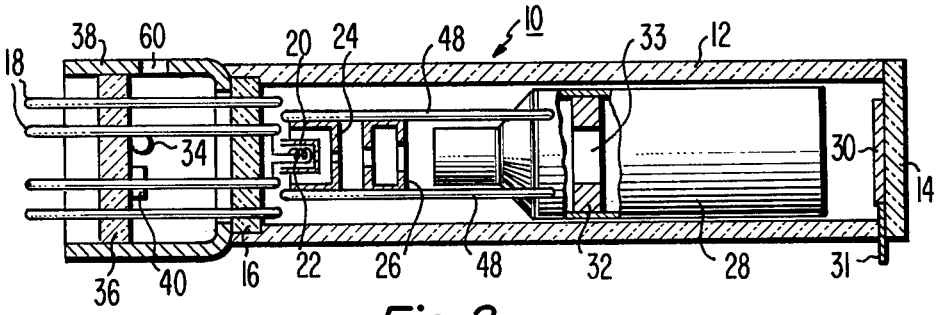

An alternative arrangement for transmitting the light from the light source 34 into the inside of the anode electrode 28 is shown in FIG. 2. One or more glass light conductors 48 may be disposed near or in contact with the base plate 16 on one end and extend into the inside of the anode electrode 28. A ring 32 of colored or frosted glass may be disposed within the inner surface of anode electrode 28 so that light emanating from the light conductors 48 passes through the ring 32 for partial control of the light intensity. An aperture 33 is provided through the ring 32 to allow passage of the electron beam from the cathode 20 to strike the target 30. Light conductors are known per se and may be utilized in this arrangement to conduct the light into the collector space of anode electrode 28 for subsequent diffusion and distribution to the target 30. Although straight light conductors 48 are depicted, various light conductor configurations may be utilized to accommodate the internal construction of the tube 10 for transmitting the light.

Figure 4:
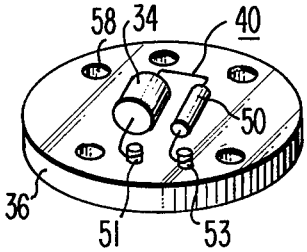
FIGS. 4 and 5 are perspective views of mounting boards each including a light source and various electric circuits for controlling the bias light intensity.

Because different photoconductors react differently to various bias light conditions, it is desirable to control the light intensity of the light source 34 to obtain a particular biased dark current of the target. For example, a certain light intensity may be required when using a standard target of undoped PbO layers while a different light intensity may be needed for doped PbO layers used in the so-called extended red tubes. This light intensity control is achieved in accordance with the presently described pick-up tube, by providing the bias light control 40, such as an electric circuit connected to the light source 34 on the board 36 as shown in FIG. 4. The light source 34 is preferably an incandescent lamp although other light sources, such as a light emitting diode (LED), may also be used. In one arrangement of the circuit 40, the light source 34 may be serially connected to a discrete resistor 50, such as a carbon or wire-wound type resistor having a fixed resistance. External connection to the circuit 40 may be made as by connections to terminals 51 and 53, respectively of the circuit 40. The light intensity of the lamp 34 can be changed by varying the current passing through the lamp 34, the current being controlled by the impedance of the serially connected circuit 40. In this arrangement, a certain circuit impedance is experimentally or analytically determined to provide a given light intensity of the lamp 34 to illuminate the target 30 as desired. The resistor 50, having the particular predetermined resistance, is then selected for connection to the lamp 34. Depending upon the circuit impedance required, additional fixed resistors may be connected with the resistor 50 to produce the desired impedance.

The control circuit 40 may also be arranged such that resistor 50 is a variable resistor of the potentiometer type. The circuit impedance may be changed by varying the resistance of the variable resistor 50 as by mechanical tuning. By changing the impedance of the electric circuit 40, the light intensity of the lamp 34 can be controlled to illuminate the target 30 as desired. The circuit 40 may include a combination of fixed and variable resistors to obtain a desired range of impedance values for adjusting the intensity of light source 34.

Figure 5:
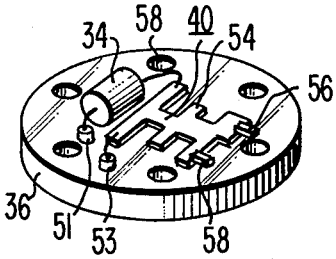

In a preferred embodiment of the control circuit 40, a printed circuit 54 of selected impedances formed by known printing methods may be serially connected to lamp 34, as shown in FIG. 5. The impedances of the circuit 40 may be changed as by trimming selected printed portions from the pattern or by adding tuning elements, such as metal strips 56 and 58. In either of the arrangements shown in FIGS. 4 and 5, a number of clearance holes 58 for the contact pins 18 are provided through the board 36 so that the board 36 may be inserted into the cup 38.

In any of the circuit 40 arrangements just described, circuit terminals 51 and 53 may be connected to an external, separate source (not shown) or connected in parallel with the electrical circuit for the filament 22. When connected to the filament 22, the control circuit 40 will operate with the filament 22 and will have its circuit impedance adapted to accommodate the 6.3 volts at which the filament typically operates.

In addition to ease of replacement, mounting the light source 34 onto the board 36 with the control circuit 40 as a subassembly, separate from the tube 10, allows for presetting a predetermined light intensity of the light source 34 prior to insertion and mounting. A suitable test fixture may be utilized to test the tube performance under varying light intensities with adjustments in the control circuit 40 impedances. Upon completion of the testing and pre-insertion adjustment for satisfactory tube performance, the board 36 subassembly is then mated to the tube 10. Further trimming or adjusting may be achieved after the board 36 is mounted by access to the control circuit 40 through an aperture 60 suitably disposed through the end cap 38.

Although the pick-up tube has been described and illustrated with one light source 34, it should be appreciated that more than one light source may be utilized depending upon the light intensity desired. Also, the light sources may include lamps of different colors to control the bias light shading. Although the light sources may be disposed substantially on or symmetrically about the center axis of the tube it is not essential since the reflection of scattered light off the inside of anode electrode 28 tends to uniformly illuminate the target 30. Unsymmetrical mounting of the light source or sources is more desirable in the pick-up tube incorporating the light isolator 35, since more uniform illumination of the target 30 is provided and light transmission to the anode electrode 28 is not interrupted by the centrally located cathode 20 and electrodes 24 and 26.

What is claimed is:

1. In a pick-up tube having an evacuated envelope and a photoconductive target electrode on an inner portion of said envelope and a light source disposed to provide an illumination onto said target for biasing the dark current of said target electrode, the improvement comprising:

means for removably mounting said light source onto said tube externally of said envelope, said mounting means comprising an end cap adhesively secured to said tube and a non-conductive board for supporting said light source accessibly disposed within said cap and removably secured to the inner surface of said cap, and means on said board for presetting and adjustably controlling the light intensity of said light source.

2. In a pick-up tube according to claim 1, wherein the material of said board is selected from the non-conductive group of materials consisting of ceramic, fiber glass and rigid plastic.

3. In a pick-up tube according to claim 1, wherein said end cap has a portion having an aperture disposed therethrough for accessibility to said presetting and control means.

4. In a pick-up tube according to claim 1, wherein said light source comprises an incandescent lamp and wherein said presetting and controlling means comprises an electric circuit disposed on said board and connected to said lamp for providing predetermined impedances to said lamp.

5. In a pick-up tube according to claim 4, wherein said electric circuit includes a variable resistor.

6. In a pick-up tube according to claim 4, wherein said electric circuit includes a circuit pattern printed on said board.

7. In a pick-up tube according to claim 4, wherein said electric circuit includes a discrete resistor.

* * * * *